US010723121B2

(12) United States Patent
Wan

(10) Patent No.: US 10,723,121 B2
(45) Date of Patent: Jul. 28, 2020

(54) INK PUMPING

(71) Applicant: Hewlett-Packard Development Company, L.P., Houston, TX (US)

(72) Inventor: Sing Yan Wan, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/302,508

(22) PCT Filed: Jul. 12, 2016

(86) PCT No.: PCT/US2016/041888

§ 371 (c)(1),
(2) Date: Nov. 16, 2018

(87) PCT Pub. No.: WO2018/013088

PCT Pub. Date: Jan. 18, 2018

(65) Prior Publication Data

US 2019/0168501 A1 Jun. 6, 2019

(51) Int. Cl.

| | |
|---|---|
| ***B41F 31/08*** | (2006.01) |
| ***F04B 43/12*** | (2006.01) |
| ***F04B 45/067*** | (2006.01) |
| ***F04B 43/00*** | (2006.01) |
| ***B41J 2/175*** | (2006.01) |
| ***F04B 43/08*** | (2006.01) |

(52) U.S. Cl.

CPC ..... *B41F 31/08* (2013.01); *B41J 2/17596* (2013.01); *F04B 43/009* (2013.01); *F04B 43/0072* (2013.01); *F04B 43/086* (2013.01); *F04B 43/1253* (2013.01); *F04B 43/1292* (2013.01); *F04B 45/067* (2013.01); *B41P 2251/112* (2013.01)

(58) Field of Classification Search

CPC ..... B41J 2/17596

See application file for complete search history.

(56) References Cited

U.S. PATENT DOCUMENTS 2,696,173 A * 12/1954 Jensen ..... F04B 43/1223 417/477.6

3,111,897 A 11/1963 Van Buskirk (Continued)

OTHER PUBLICATIONS

Stenner, "Product Line Specifications Classic Series 45/85", 2 pages.

*Primary Examiner* — Shelby L Fidler

(74) *Attorney, Agent, or Firm* — HP Inc. Patent Department

(57) ABSTRACT

The present subject matter describes a system for ink pumping. In an example implementation, the system comprises a tube having a first end and a second end, a peristaltic pump to pump ink through the tube, a first ink port, and a second ink port. The system includes a first fluid chamber between the first end of the tube and the first ink port. The first fluid chamber is configured to hold the ink entering and exiting the tube through the first end to dampen flow of the pumped ink. The system also includes a second fluid chamber between the second end of the tube and the second ink port. The second fluid chamber is configured to hold the ink entering and exiting the tube through the second end to dampen flow of the pumped ink.

16 Claims, 8 Drawing Sheets

(56) References Cited

U.S. PATENT DOCUMENTS

| | | | | |
|---|---|---|---|---|
| 3,723,030 | A * | 3/1973 | Gelfand | F04B 43/1284 417/475 |
| 3,972,656 | A * | 8/1976 | Porter | F02M 37/046 417/542 |
| 4,717,276 | A * | 1/1988 | O'Brien | B05C 17/0308 15/230.11 |
| 5,037,274 | A | 8/1991 | Holmes et al. | |
| 6,041,709 | A | 3/2000 | Wells et al. | |
| 6,082,977 | A | 7/2000 | Nishioka | |
| 6,641,249 | B2 | 11/2003 | Miyauchi | |
| 8,529,229 | B2 | 9/2013 | Asai et al. | |
| 2007/0296744 | A1 * | 12/2007 | Kubota | B41J 2/17596 347/7 |
| 2015/0042718 | A1 | 2/2015 | Kameyama | |
| 2016/0138579 | A1 * | 5/2016 | Norman | F04B 9/02 417/374 |
| 2017/0106661 | A1 * | 4/2017 | Ueda | B41J 2/17596 |

* cited by examiner

INK PUMPING

BACKGROUND

Printers print on a printing medium by ejecting ink through a nozzle on a print head of the printer. The ink for printing is supplied from an ink reservoir. The ink reservoir is connected with the print head through a tube. The printer includes a system for pumping ink through the tube between the ink reservoir and the print head.

BRIEF DESCRIPTION OF DRAWINGS

The following detailed description references the drawings, wherein.

DETAILED DESCRIPTION

Figure 1:
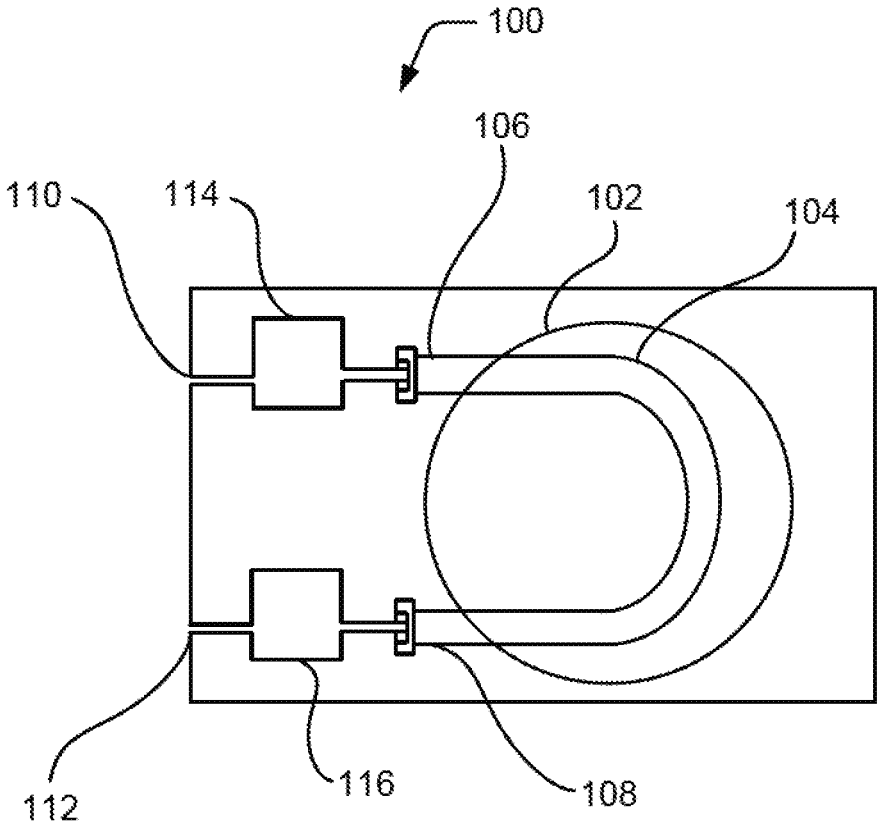
FIG. 1 illustrates a system for pumping ink in a printer, according to an example implementation of the present subject matter.

A printing device, such as an ink-jet printer prints on a medium by ejecting ink through a nozzle of a print head of the printer. The print head receives a supply of ink from an ink reservoir which can be a replaceable cartridge, a fixed ink tank, and the like. For supplying ink to the print head, the ink is pumped through a tube connecting the ink reservoir with the print head. The ink may be pumped through the tube using a peristaltic pump.

A differential pressure is maintained between the ink reservoir and the print head across the tube for pumping ink from the ink reservoir to the print head. The differential pressure at which ink is pumped through the tube connecting the ink reservoir with the print head may not remain uniform. Variations in the differential pressure may lead to irregularities in the flow of ink. Irregularities in the flow of ink to the print head may result in either excess ink being ejected through the nozzle of the print head or inadequate supply of ink at the nozzle. Both the scenarios may lead to poor print quality.

Further, the tube connecting the ink reservoir with the print head is generally formed from an elastomeric material, such as rubber or plastic. Due to the irregularities in the flow of ink through the tube, bore of the elastomeric tube is subjected to frequent expansion and contraction which may result in wear and tear of the tube. This may reduce the lifespan of the tube.

Also, stark variations in the differential pressure within the tube during pumping of ink may result in vibrations of the tube and a housing of the pump which in turn may cause the printer to vibrate. An additional pressure regulator may be used to regulate the differential pressure in the tube. The pressure regulator may make the printer assembly complex. Also, the pressure regulator is not easily serviceable in case of faults and is costly.

Further, ink may be pumped through the tube at a differential pressure of up to 15 psi between the ink reservoir and the print head. For high quality print jobs, for example, during printing on posters or while printing on any absorbent print media, such as cotton cloth, absorbent cellulose papers, etc., ink from the ink reservoir may have to be supplied at a higher flow rate to the print head. To achieve the higher flow rate, a higher differential pressure, i.e., more than 15 psi may have to be maintained between the ink reservoir and the print head, which may overload and fail the pump.

The present subject matter describes systems for pumping ink in printers, and printers having such systems. The system, may also be referred to as an ink pumping system, and the printers of the present subject matter may facilitate in reducing irregularities in the flow of ink through the tube and thereby providing a steady flow of ink. As a result, the print quality may be improved. Also, a steady flow of ink through the tube may reduce wear and tear of the tube; may increase lifespan of the tube; and may reduce vibrations in the ink pumping systems and in the printers. Further, the ink pumping systems of the present subject matter can be operated at higher flow rates for the ink without overloading the ink pumping systems.

In an example implementation of the present subject matter, the ink pumping system includes a peristaltic pump having a tube to flow ink between an ink reservoir and a print head of the printer. The peristaltic pump can pump ink through the tube between the ink reservoir and the print head. The ink pumping system includes two ink ports. A first ink port interfaces a first end of the tube with one of the ink reservoir and the print head. A second ink port interfaces a second end of the tube with the other of the ink reservoir and the print head. An ink port may be understood as a port of entry/exit of the ink to/from the ink pumping system. Further, the ink pumping system includes two fluid chambers, with a first fluid chamber being connected between the first end of the tube and the first ink port, and a second fluid chamber being connected between the second end of the tube and the second ink port. The first fluid chamber operates to hold the ink entering and exiting the tube through the first end to dampen flow of the pumped ink through the tube. The second fluid chamber operates to hold the ink entering and exiting the tube through the second end to dampen flow of the pumped ink through the tube.

The first fluid chamber and the second fluid chamber arrest the flow of ink at the first and second ends of the tube, respectively, and thereby reduce irregularities in the flow of ink. Thus, a steady flow of ink through the tube may be achieved. As a steady flow of ink through the tube is achieved, vibrations of the tube may be reduced. Also, with a steady flow of ink, the bore of the tube may not be subjected to frequent expansions and contractions and thereby the amount of wear and tear on the tube may be reduced.

In an example, the ink pumping systems of the present subject matter, have a planetary gear assembly to move a roller along the length of the tube to enable peristaltic pumping action for flowing the ink through the tube. The planetary gear assembly rotates the roller with a high torque which facilitates in establishing an increased differential pressure between the ink reservoir and the print head. With the increased differential pressure, the flow rate of the ink pumped through the tube may increase. The higher flow rate helps in achieving a better print quality.

In an example, the ink pumping systems of the present subject matter include an optical sensor to detect ink leakage within the system. Detection of ink leakage makes the ink pumping systems and printers of the present subject matter more reliable, and helps in preventing wastage of ink and damage to the print media due to ink leakage.

The following detailed description refers to the accompanying drawings. Wherever possible, the same reference numbers are used in the drawings and the following description to refer to the same or similar parts. While several examples are described in the description, modifications, adaptations, and other implementations are possible. Accordingly, the following detailed description does not limit the disclosed examples. Instead, the proper scope of the disclosed examples may be defined by the appended claims.

FIG. 1 illustrates a system 100 for pumping ink in a printer, according to an example implementation of the present subject matter. The system 100, also referred to as the ink pumping system, includes a peristaltic pump 102 and a tube 104 having a first end 106 and a second end 108. In an example implementation, the tube 104 is formed of elastomeric material, such as plastic, rubber, etc. The peristaltic pump 102 operates to pump ink through the tube 104 between an ink reservoir (not shown) and a print head (not shown) of the printer.

The system 100 also includes two ink ports. A first ink port 110 allows ink to enter/exit through the first end 106 of the tube 104 and a second ink port 112 allows ink to enter/exit through the second end 108 of the tube 104. The first ink port 110 may be connected to one of the ink reservoir and the print head and the second ink port 112 may be connected to the other of the ink reservoir and the print head.

Further, the system 100 includes two fluid chambers. A first fluid chamber 114 is between the first end 106 and the first ink port 110, and a second fluid chamber 116 is between the second end 108 and the second ink port 112. The first fluid chamber 114 is configured to hold the ink entering and exiting the tube 104 through the first end 106 to dampen flow of ink pumped through the tube 104. By trapping the flow of ink at the first end 106, the first fluid chamber 114 reduces/eliminates irregularities in the flow of ink and thereby ensures a steady flow of ink through the tube 104. Similarly, the second fluid chamber 116 is configured to hold the ink entering and exiting the tube 104 through the second end 108 to dampen flow of ink pumped through the tube 104. By trapping the flow of ink at the second end 108, the second fluid chamber 116 reduces/eliminates irregularities in the flow of ink and thereby ensures a steady flow of ink through the tube 104.

Figure 2:
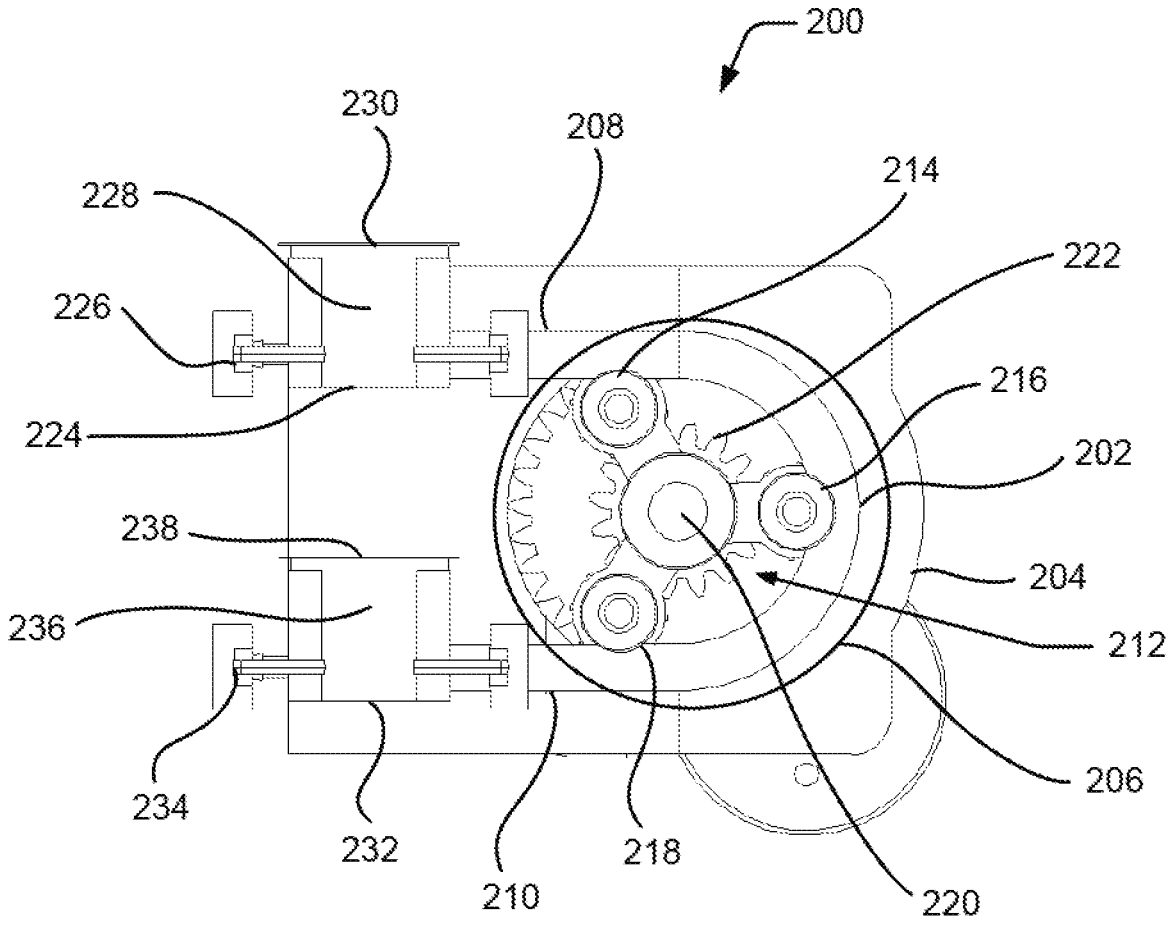
FIG. 2 illustrates a sectional view of a system for pumping ink in a printer, according to an example implementation of the present subject matter.

FIG. 2 illustrates a sectional view of a system 200 for pumping ink in a printer, according to an example implementation of the present subject matter. The system 200, also referred to as the ink pumping system, includes a tube 202 positioned in the form of an arc within a housing 204 of the system 200. In an example implementation, the housing 204 has an arc-shaped slot for positioning the tube 202 within the housing 204. The tube 202 is made of a flexible material and may be bent in the form of an arc for being fitted in the arc-shaped slot of the housing 204. In an example implementation, the tube 202 is formed of an elastomeric material, like rubber, plastic, etc.

The system 200 includes a peristaltic pump 206 to flow ink through the tube 202 between a first end 208 and a second end 210 of the tube 202. The peristaltic pump 206 includes a roller assembly 212. The tube 202 is mounted on the roller assembly 212. The roller assembly 212 has three rollers viz., a first roller 214, a second roller 216, and a third roller 218, as shown, to squeeze the tube 202 at different positions to flow ink through the tube 202 through peristaltic action.

The roller assembly 212 also includes a planetary gear assembly mounted on a planet shaft 220. The planetary gear assembly has a sun gear 222 at the center and coupled to the planet shaft 220. The planetary gear assembly also includes planet gears (not shown) operable to revolve around the sun gear 222. Each of the three rollers of the roller assembly 212 are coupled to planet gears. The roller assembly 212 is illustrated and described in detail through FIGS. 3*a* and 3*b*.

In an example implementation, the planet shaft 220 is coupled to and rotatably driven by a motor (not shown). When the planet shaft 220 is rotated by a motor, the sun gear 222 rotates along with the planet shaft 220 and the planet gears coupled with respective rollers revolve around the sun gear 222. As the rollers revolve around the sun gear 222, each of the three rollers move through different positions along the length of the tube 202. The tube 202 being flexible is progressively squeezed at respective points of contact of the tube 202 with each of the three rollers enabling ink to flow through the tube 202 through peristaltic pumping action. Although, the roller assembly 212 is shown to have three rollers; however, the roller assembly of the peristaltic pump may have one roller or more than one roller to squeeze the tube, at different positions, to flow ink through the tube.

Further, as shown in FIG. 2, the first end 208 of the tube 202 is connected to one end of a first bi-directional interconnector 224. The other end of the first bi-directional interconnector 224 forms a first ink port 226 of the system 200. In an example implementation, the first ink port 226 may be connected to an ink reservoir or a print head of the printer. The first ink port 226 allows ink to enter and exit the tube 202. The first bi-directional interconnector 224 has a first fluid chamber 228 to hold ink entering and exiting the tube 202 through the first end 208. The first fluid chamber 228 is integral to a flowpath of the first bi-directional interconnector 224 and is positioned between the first end 208 of the tube 202 and the first ink port 226 of the system 200. The first fluid chamber 228 is sealed by providing an air tight seal 230 on the top. In an example implementation, a sealing film, such as a plastic film may be heat staked on top of the first fluid chamber 228 to provide the air tight seal 230.

The second end 210 of the tube 202 is connected to one end of a second bi-directional interconnector 232. The other end of the second bi-directional interconnector 232 forms a second ink port 234 of the system 200. In an example implementation, the second ink port 234 may be connected to an ink reservoir or a print head of the printer. The second ink port 234 allows ink to enter and exit the tube 202. The second bi-directional interconnector 232 has a second fluid chamber 236 to hold ink entering and exiting the tube 202 through the second end 210. The second fluid chamber 236 is integral to a flowpath of the second bi-directional interconnector 232 and is positioned between the second end 210 of the tube 202 and the second ink port 234 of the system 200. The second fluid chamber 236 is sealed by providing an air tight seal 238 on the top. In an example implementation, a sealing film, such as a plastic film may be heat staked on top of the second fluid chamber 236 to provide the air tight seal 238.

Figure 3A:
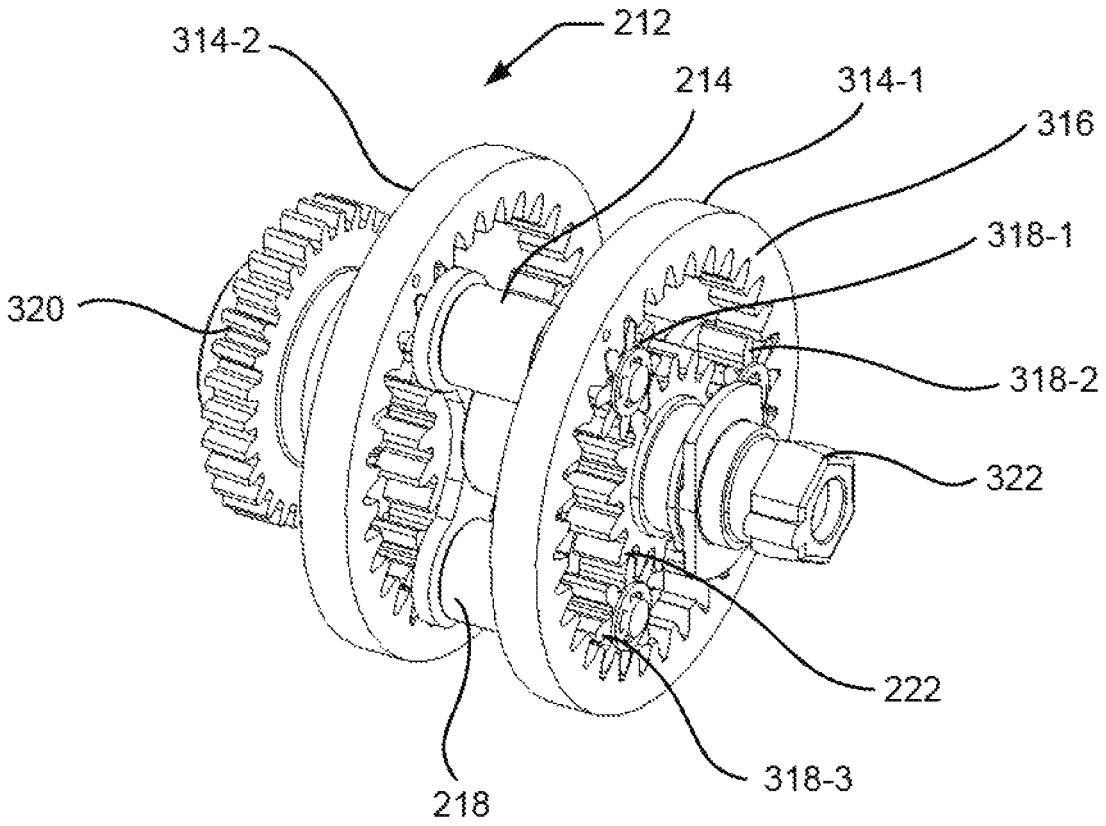
FIG. 3*a* illustrates a roller assembly of the system of FIG. 2, according to an example implementation of the present subject matter.
Figure 3B:
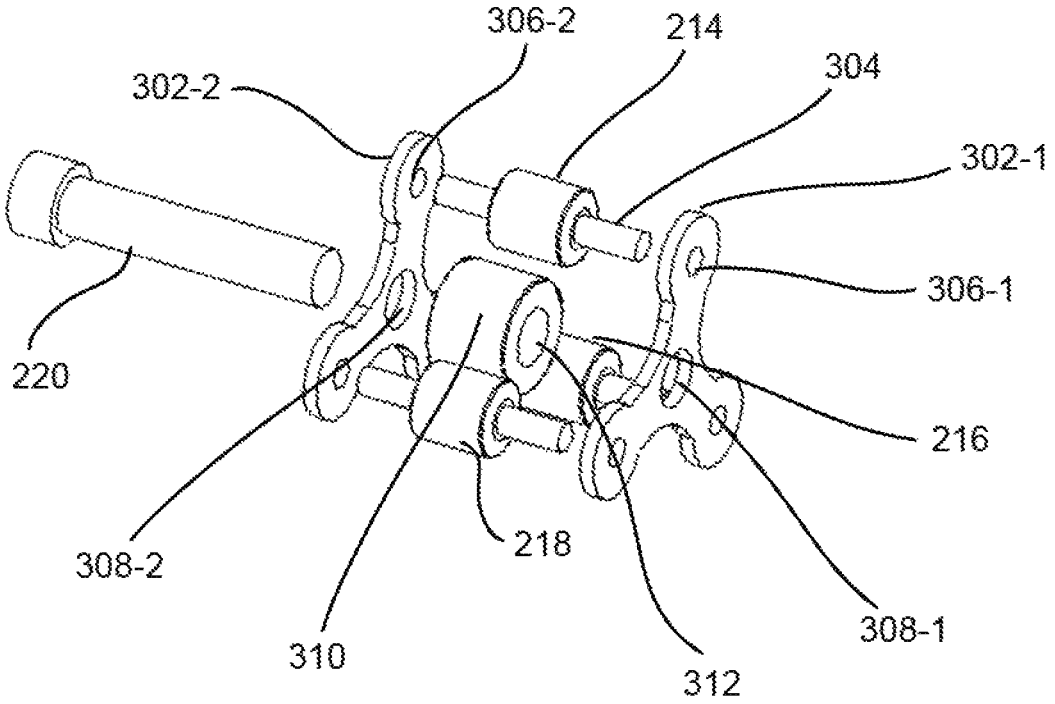
FIG. 3*b* illustrates arrangement of rollers in the roller assembly as illustrated in FIG. 3*a*, according to an example implementation of the present subject matter.

FIG. 3*a* illustrates the roller assembly 212 of the system 200 of FIG. 2, according to an example implementation of the present subject matter. The roller assembly 212 may also be referred to as an epicyclic roller assembly. The arrangement of the three rollers 214, 216, and 218 in the roller assembly 212 is illustrated through FIG. 3*b*, according to an example implementation of the present subject matter.

The three rollers of the roller assembly 212 are held in between a first planet carrier 302-1 and a second planet carrier 302-2. The first roller 214 is mounted on a roller shaft 304. One end of the roller shaft 304 passes through an opening 306-1 in an arm of the first planet carrier 302-1 and the other end of the roller shaft 304 passes through an opening 306-2 in an arm of the second planet carrier 302-2. The second roller 216 and the third roller 218 are also mounted on respective roller shafts and held between the first planet carrier 302-1 and the second planet carrier 302-2 by a similar arrangement.

The first planet carrier 302-1 has a central opening 308-1 and the second planet carrier 302-2 has a central opening 308-2. A spacer 310 with an opening 312 is positioned between the first planet carrier 302-1 and the second planet carrier 302-2. The planet shaft 220 passes through the central opening 308-1 of the first planet carrier 302-1, the opening 312 of the spacer 310, and the central opening 308-2 of the second planet carrier 302-2.

Further, the planetary gear assembly of the roller assembly 212 includes a first set of planetary gears 314-1 and a second set of planetary gears 314-2, as shown in FIG. 3*a*. The first set of planetary gears 314-1 is mounted at one end of the planet shaft 220 and abuts the first planet carrier 302-1. The second set of planetary gears 314-2 is mounted at the other end of the planet shaft 220 and abuts the second planet carrier 302-2. Thus, the rollers 214, 216, and 218 along with the first and second planet carriers are held between the first set of planetary gears 314-1 and the second set of planetary gears 314-2.

The first set of planetary gears 314-1 includes a planet ring 316, a sun gear 222 at the center of the planet ring 316, and three planet gears, viz., a first planet gear 318-1, a second planet gear 318-2, and a third planet gear 318-3 which revolve around the sun gear 222. The three planet gears are held together around the sun gear 222 by the planet ring 316 which forms a perimeter of the first set of planetary gears 314-1. The sun gear 222 is mounted on the planet shaft 220 and abuts the first planet carrier 302-1. The first planet gear 318-1 is mounted on one end of the roller shaft 304 of the first roller 214 and abuts the first planet carrier 302-1. Similarly, the second planet gear 318-2 and the third planet gear 318-3 are mounted on corresponding roller shafts of the second roller 216 and the third roller 218, respectively. The second set of planetary gears 314-2 has an arrangement of sun gear, planet gears, and planet ring similar to the arrangement of the sun gear, the planet gears, and the planet ring as in the first set of planetary gears 314-1.

As described earlier, the planet shaft 220 is driven by a motor (not shown). A motor gear 320 is mounted on the planet shaft 220 between an end of the planet shaft and the second set of planetary gears 314-2. The motor gear 320 is coupled to a transmission assembly of the motor that drives the motor gear 320 and in turn rotates the planet shaft 220. In an example implementation, the transmission assembly of the motor includes a transmission belt or a transmission chain.

Further, a scalable drive shaft 322 is mounted on the planet shaft 220, such that the scalable drive shaft 322 abuts the first set of planetary gears 314-1. In an example implementation, the scalable drive shaft 322 may couple with another ink pumping system identical to the system 200. The scalable drive shaft 322 can connect with a motor gear of the other ink pumping system and thereby drive the other ink pumping system. Thus, in an example implementation, two or more ink pumping systems identical to the system 200 can be integrated to form an array of ink pumping systems.

Figure 4A:
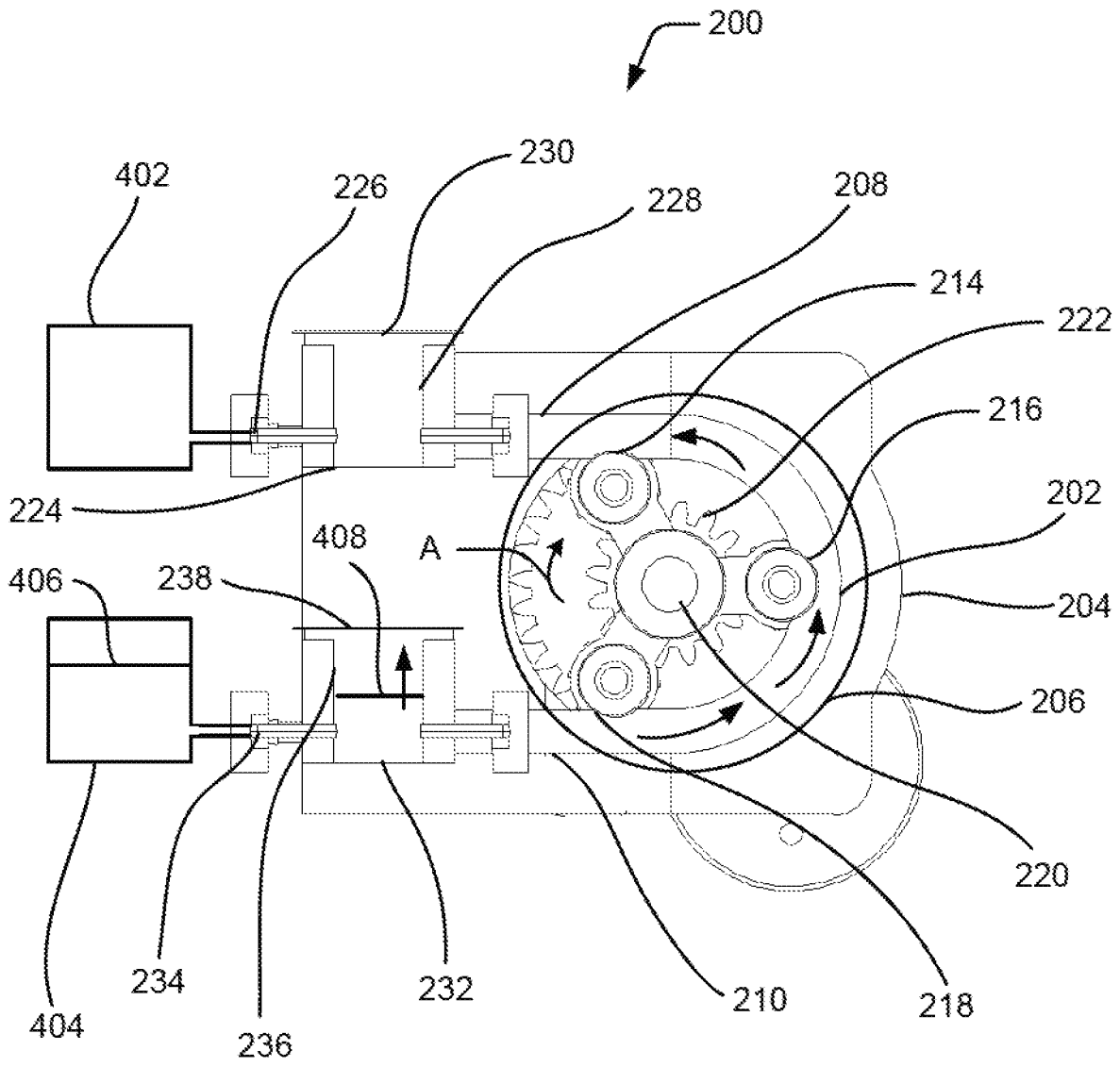
FIGS. 4*a* and 4*b* illustrate the sequence of operations for transferring ink between two ends of a tube of the system of FIG. 2, according to an example implementation of the present subject matter.
Figure 4B:
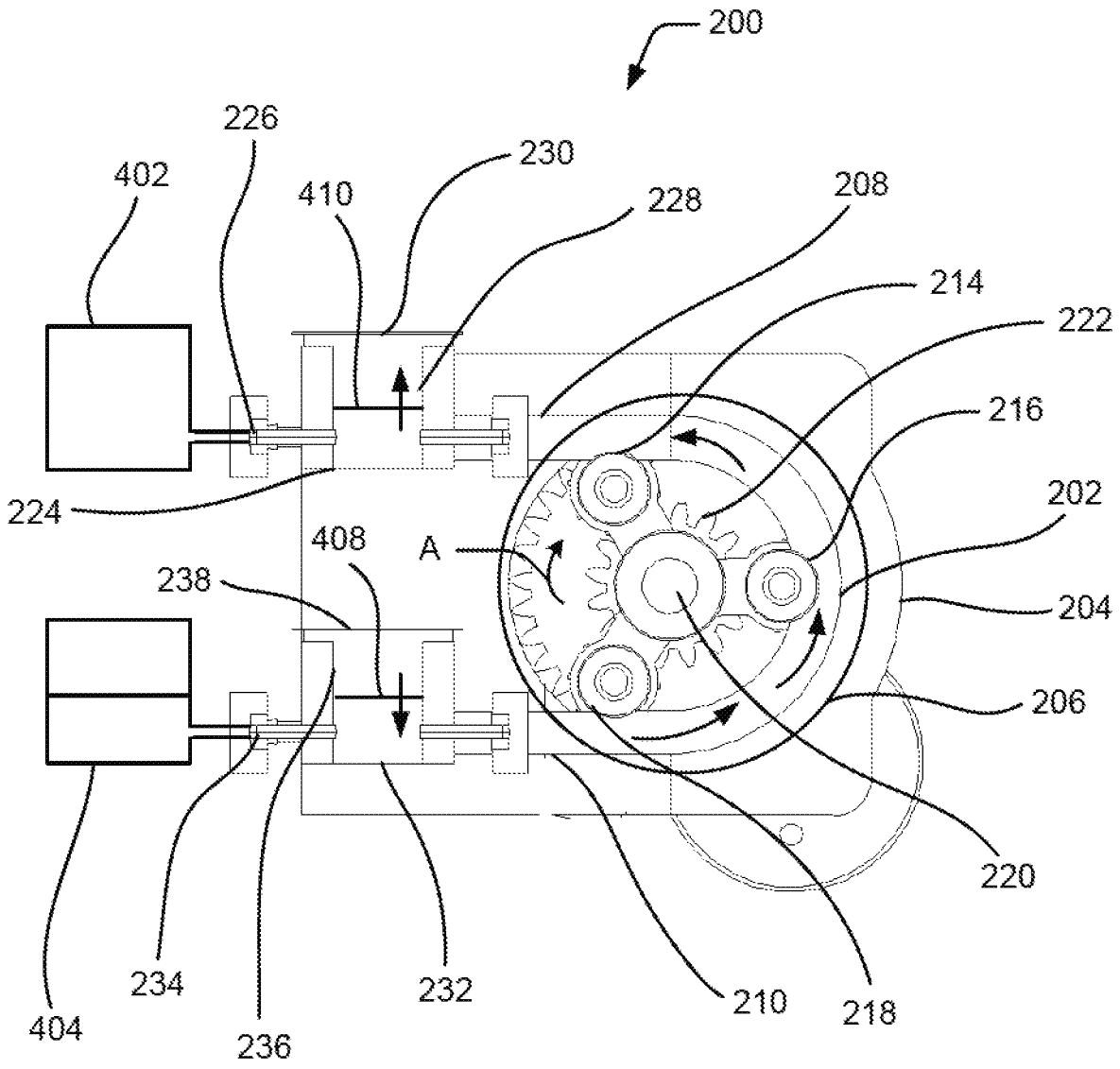

FIGS. 4*a* and 4*b* illustrate the sequence of operations for transferring ink between two ends of the tube of the system 200, according to an example implementation of the present subject matter. Consider a case where the system 200 is installed within a printer with the first ink port 226 being connected to a print head 402 of the printer and the second ink port 234 being connected to an ink reservoir 404, as shown in FIG. 4*a*. The level of ink in the ink reservoir 404 is referenced as 406. With the system 200 installed within the printer, ink from the ink reservoir 404 flows through the second ink port 234 into the second bi-directional interconnector 232. The ink gets collected inside the second fluid chamber 236 of the second bidirectional interconnector 232, and the level of ink, referenced as 408, inside the second fluid chamber 236 gradually rises.

When the printer is switched on, a motor (not shown) coupled to the planet shaft 220 rotates the planet shaft 220. The direction of rotation of the planet shaft 220 is depicted by arrow A. The sun gear 222 mounted on the planet shaft 220 rotates along with the planet shaft 220 in the direction of arrow A. Each of the planet gears coupled to the sun gear 222 revolve around the sun gear 222 in the same direction as depicted by arrow A. The planet gears also rotate about their own axis in a direction opposite to arrow A.

As the planet gears revolve around the sun gear 222, each of the rollers coupled to respective planet gears revolve around the sun gear 222 in the direction of arrow A. While revolving around the sun gear 222, each of the rollers progressively squeezes the tube 202 at different positions to create a pressure difference between the second fluid chamber 236 and the point of squeezing, thereby allowing the ink stored in the second fluid chamber 236 to be flowed along the tube 202 towards the first fluid chamber 228 through peristaltic pumping action.

After a certain number of revolutions of the rollers around the sun gear 222, the ink reaches the first end 208 of the tube 202. After exiting the first end 208, the ink enters the first bi-directional interconnector 224 and gets stored in the first fluid chamber 228 of the first bi-directional interconnector 224. As the number of revolutions of the rollers around the sun gear 222 increases, more and more ink from the second fluid chamber 236 is pumped through the tube 202 and the level of ink 408 in the second fluid chamber 236 falls, as shown in FIG. 4*b*. The ink pumped through the tube 202 gets stored in the first fluid chamber 228 and the level of ink, referenced as 410, in the first fluid chamber 228 gradually rises. From the first fluid chamber 228, the ink gradually passes through the first ink port 226 to the print head 402. After a certain number of revolutions of the sun gear 222, both the first fluid chamber 228 and the second fluid chamber 236 are filled with ink.

With the arrangement of the present subject matter, the ink instead of rushing directly into the tube 202 under the influence of the peristaltic pumping action, is held up inside the second fluid chamber 236 before entering the tube 202. The second fluid chamber 236 thus dampens the flow of ink from the ink reservoir 404 into the tube 202 and thereby reduces pulsation in the flow of ink through the tube 202. Similarly, the first fluid chamber 228 arrests any sudden discharge of ink to the print head 402 and thereby dampens the flow of ink between the ink reservoir 404 and the print head 402. Thus, the first and the second fluid chambers reduces/eliminates irregularities in the flow of ink and thereby helps to achieve a steady flow of ink between the ink reservoir 404 and the print head 402.

In an example implementation, the motor can rotate the planet shaft 220 in a direction opposite to the direction depicted by arrow A. The sun gear 222 mounted on the planet shaft 220 also rotates along with the planet shaft 220 in a direction opposite to the direction of arrow A. In such a scenario, the rollers coupled to the sun gear 222 revolve around the sun gear 222 in a direction opposite to the direction of arrow A and ink is transferred from the first end 208 to the second end 210 of the tube 202. With this arrangement, ink can be passed from the print head 402 back to the ink reservoir 404. Thus, the system 200 of the present subject matter facilitates a bidirectional flow of ink between the ink reservoir and the print head which enables ink to be recirculated through the system 200 resulting in efficient use of ink in the printer.

Figure 5:
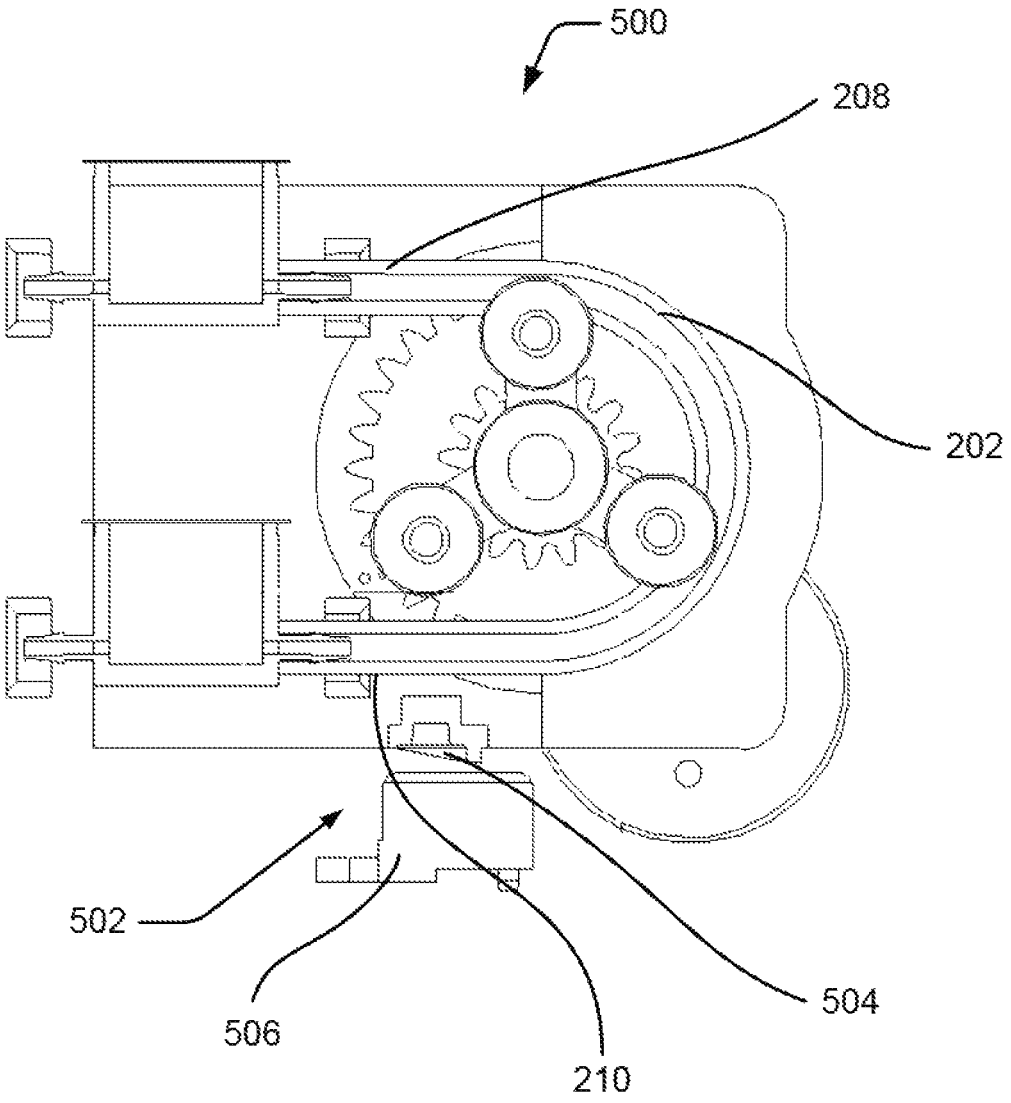
FIG. 5 illustrates a system for pumping ink in a printer, according to an example implementation of the present subject matter.

FIG. 5 illustrates a system 500 for pumping ink in a printer, according to an example implementation of the present subject matter. The system 500 is similar to the system 200 as illustrated in FIG. 2. The system 500 includes an optical sensor 502 to detect ink leakage from the tube 202. The optical sensor 502 includes an optical prism 504 positioned under the second end 210 of the tube 202, such that any ink leaking from the second end 210 may be collected on a surface of the optical prism 504. In an example implementation, the optical prism 504 may be positioned under the first end 208 of the tube 202 to detect ink leakage from the first end 208 of the tube 202.

The optical sensor 502 also includes a light source (not shown) and a leakage detector 506. The light source directs a light beam on the same surface of the optical prism 504 on which the leaked ink may be collected. The light beam from the light source is directed at an angle of incidence greater than the critical angle of the optical prism with air as the surrounding medium. The leakage detector 506 is positioned to collect the light beam reflected from the surface of the optical prism 504. In the absence of ink on the surface of the optical prism 504, i.e., with no ink leakage, the light beam is reflected back from the optical prism 504 to the leakage detector 506 due to a total internal reflection at the surface of the optical prism 504. The leakage detector 506 detects the reflected light and records the intensity of the reflected light to determine that there is no ink leakage.

In the presence of ink on the surface of the optical prism 504, i.e., with ink leakage, the critical angle of the optical prism 504 increases. The angle of incidence of the light beam is set to be less than the critical angle with ink as the surrounding medium of the optical prism 504. Therefore, with ink accumulated on the surface of the optical prism 504, the light beam is refracted at the surface of the optical prism 504. The leakage detector 506 does not receive the reflected light. The leakage detector 506 may accordingly determine the presence of ink on the surface of the optical prism 504 based on the change in intensity of the reflected light.

In an example implementation, the leakage detector 506 may be coupled to a display unit (not shown) of the printer. If the leakage detector 506 determines that ink has accumulated on the surface of the optical prism 504, the leakage detector 506 may generate an ink leakage alert to be displayed on the display unit for any preventive or protective actions.

Figure 6:
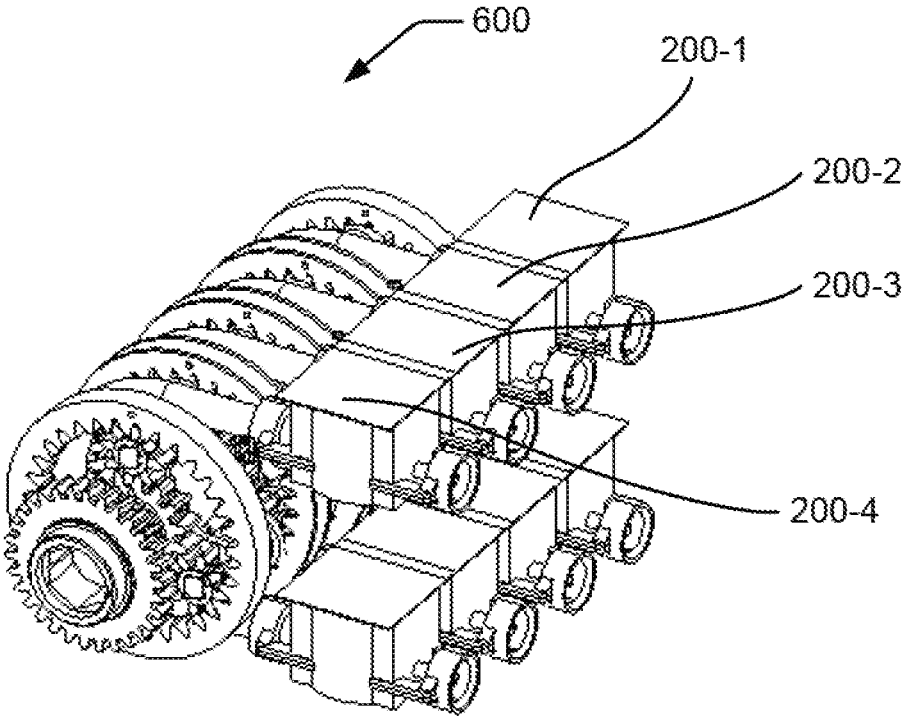
FIG. 6 illustrates an array of systems for pumping ink in a printer, according to an example implementation of the present subject matter.

FIG. 6 illustrates an array of systems 600 for pumping ink in a printer, according to an example implementation of the present subject matter. The array of systems 600 may be formed by coupling a plurality of ink pumping systems 200-1, 200-2, 200-3 and 200-4, each being identical to the system 200. Although FIG. 6 shows four ink pumping systems in the array 600; however, the array may be formed of two or more than two ink pumping systems. It may be noted that the scalable drive shaft 322 of the system 200, shown in FIG. 3*a*, enables the systems 200-1 to 200-4 to be coupled together. Each of the systems 200-1 to 200-4 in the array 600 can pump ink of different colors such as C (cyan), M (magenta), Y (yellow), and K (black) from an ink reservoir to a print head of a printer.

Although implementations for systems for pumping ink in printers are described in language specific to structural features, it is to be understood that the present subject matter is not limited to the specific features described. Rather, the specific features are disclosed and explained as example implementations for systems for pumping ink in printers.

We claim:

1. A system comprising:

a tube having a first end and a second end;

a peristaltic pump to pump ink through the tube;

a first ink port;

a second ink port;

a first fluid chamber between the first end of the tube and the first ink port, the first fluid chamber configured to hold the ink entering and exiting the tube through the first end to dampen flow of the pumped ink;

a first bi-directional interconnector having a flowpath to which the first fluid chamber is integral; and a second fluid chamber between the second end of the tube and the second ink port, the second fluid chamber configured to hold the ink entering and exiting the tube through the second end to dampen flow of the pumped ink.

2. The system as claimed in claim 1, wherein the peristaltic pump comprises at least one roller to squeeze the tube, at different positions, to pump the ink through the tube through peristaltic action.

3. The system as claimed in claim 1, wherein one end of the first bi-directional interconnector is connected to the first end of the tube and other end of the first bi-directional interconnector forming the first ink port.

4. The system as claimed in claim 1, further comprising a second bi-directional interconnector wherein the second fluid chamber is integral to a flowpath of the second bi-directional interconnector, one end of the second bi-directional interconnector being connected to the second end of the tube and other end of the second bi-directional interconnector forming the second ink port.

5. The system as claimed in claim 1, further comprising an optical sensor to detect ink leakage from the tube.

6. The system as claimed in claim 5, wherein the optical sensor comprises:

an optical prism positioned under one of the first end and the second end of the tube, the optical prism configured to receive, on a surface thereof, ink leaking out from the leakage in the tube;

a light source positioned to direct a light beam on the surface of the prism; and a leakage detector to determine the ink leakage from the tube based on intensity of light reflected back from the surface of the prism.

7. A system comprising:

a tube mounted on a roller assembly, the roller assembly including at least one roller to squeeze the tube, at different positions, to pump ink through the tube through peristaltic action;

a first bi-directional interconnector connected at a first end of the tube, the first bi-directional interconnector having a flowpath to which a first fluid chamber of the first bi-directional interconnector is integral, the first fluid chamber configured to hold the ink entering and exiting the tube through the first end to dampen flow of the pumped ink; and a second bi-directional interconnector connected at a second end of the tube, the second bi-directional interconnector having a flowpath to which a second fluid chamber of the second bi-directional connector is integral, the second fluid chamber configured to hold the ink entering and exiting the tube through the second end to dampen flow of the pumped ink.

8. The system as claimed in claim 7, the roller assembly including a planetary gear assembly mounted on a planet shaft driven by a motor, wherein the planetary gear assembly is coupled to the at least one roller to move the at least one roller through the different positions along a length of the tube.

9. The system as claimed in claim 8, wherein the planetary gear assembly is rotated, by the motor, in a first direction to transfer ink from the first end to the second end of the tube, and wherein the planetary gear assembly is rotated, by the motor, in a second direction opposite to the first direction to transfer ink from the second end to the first end of the tube.

10. The system as claimed in claim 8, the roller assembly including a scalable drive shaft coupled to the planet shaft, wherein the scalable drive shaft is connectable with another system for forming an array of systems for pumping ink in a printer.

11. The system as claimed in claim 7, wherein the first bi-directional interconnector has an end that forms an ink port connectable to one of an ink reservoir and a print head of a printer.

12. The system as claimed in claim 7, wherein the second bi-directional interconnector has an end that forms an ink port connectable to one of an ink reservoir and a print head of a printer.

13. The system as claimed in claim 7, further comprising an optical sensor to detect ink leakage from the tube.

14. A printer comprising:

an array of systems for pumping ink in the printer, each of the systems comprising:

an epicyclic roller assembly having at least one roller coupled to a planetary gear assembly mounted on a planet shaft;

a tube mounted on the epicyclic roller assembly, the at least one roller configured to squeeze the tube, at different positions, to flow ink through the tube through peristaltic action;

a first fluid chamber connected at a first end of the tube, the first fluid chamber configured to hold the ink entering and exiting the tube through the first end to dampen flow of the pumped ink;

a first bi-directional interconnector having a flowpath to which the first fluid chamber is integral;

a second fluid chamber connected at a second end of the tube, the second fluid chamber configured to hold the ink entering and exiting the tube through the second end to dampen flow of the pumped ink; and a scalable drive shaft coupled to the planet shaft and connectable to a planet shaft of another system to form the array of systems.

15. The printer as claimed in claim 14, further comprising an optical sensor to detect ink leakage from the tube.

16. The printer as claimed in claim 14, further comprising a second bi-directional interconnector having a flowpath to which the second fluid chamber is integral.

* * * * *